United States Patent [19]

Hicks

[11] 4,258,504

[45] Mar. 31, 1981

[54] CABLE RELEASE AND LATCH

[76] Inventor: Harry H. Hicks, 1599 Knollstone, St. Louis, Mo. 63135

[21] Appl. No.: 956,915

[22] Filed: Nov. 2, 1978

[51] Int. Cl.[3] ..... E06B 9/02; E06B 3/68

[52] U.S. Cl. ..... 49/56; 292/171

[58] Field of Search ..... 49/50, 56, 62, 63; 292/166, 171, 225; 70/417

[56] References Cited

U.S. PATENT DOCUMENTS

| | | | |
|---|---|---|---|
| 1,276,117 | 8/1918 | Riebe | 70/417 X |
| 2,572,730 | 10/1951 | Jones et al. | 292/171 |
| 4,127,966 | 12/1978 | Schmidt | 49/56 |

FOREIGN PATENT DOCUMENTS

| | | | |
|---|---|---|---|
| 520973 | 1/1956 | Canada | 292/171 |

*Primary Examiner*—Kenneth Downey

*Attorney, Agent, or Firm*—Rogers, Eilers & Howell

[57] ABSTRACT

A cable release and latch for a security guard hinged to a window or the like has a spring loaded plunger swedged into an outer frame thereof. An armored cable with a flexible inner cable is connected to the spring loaded plunger and extends to a foot treadle operator and shield which may be mounted on the floor inside the opening. Sufficient length of cable is provided to allow free movement of the guard about its hinges. The security guard may thereby be quickly and easily opened without a key by stepping on the foot treadle operator. If the armored cable is severed, the spring loaded plunger advances further into the keeper which retracts the flexible cable within the armored housing to prevent the manual operation of the latch without further dismantling of the cable.

8 Claims, 6 Drawing Figures

CABLE RELEASE AND LATCH

BACKGROUND AND SUMMARY

Security steel guards having steel bars and hinged over a door or window opening or the like have been used for many years to discourage unauthorized entry. In the past, hasps and slide bolts were provided for use with a padlock and this design has given way to integral tamper-proof bolt locks which may be keyed to use the same key as the normal door. A significant development has been applicant's invention of a multiple piece adjustable security gate which is suitable for installation in doors having widths varying from twenty-eight inches to thirty-eight inches or more. Applicant's gate has been patented under U.S. Pat. No. 4,026,070, the disclosure of which is incorporated herein by reference.

While the development of hinged protective guards having locks has increased the applications and numbers of installations for security guards, there has been a growing concern about the need to quickly and easily open these devices in the case of an emergency. For example, if a fire were to break out in a home having security guards installed and locked in place, it would be important to be able to quickly and easily open the security guards. This may be accomplished with present designs by having duplicate keys stored near each guard and readily accessible for use in emergencies. However, some municipalities have begun to insist on keyless locking mechanisms which permit the opening of security guards without having to search for a key or the like. A security guard which provided these features would allow the rapid and easy exit from a home while still affording substantially increased protection from the entry of burglars, prowlers and other persons with nefarious intent.

There have been several attempts in the prior art to solve this problem but these devices have been generally expensive to install and weaken the security provided by the guard. One of these devices includes a hinged security guard with a keeper having a spring and keyway welded to the frame, opposite the hinge. A rod is mounted and extends through the window casing or door jamb and wall and has a key which extends into the keyway of the keeper and is rotated to secure the guard in the closed position. An operating handle is attached to the inside end of the rod and may be used to turn the rod to open and close the guard. As is evident, it can be very expensive to install an operating rod through a wall and window casing or door jamb, especially when the device must be suitable for use with the wide variety of wall construction found in various parts of any community. For example, the wall may be a concrete basement wall, a simple two by four and plaster board wall, a full brick and plaster wall, etc. Some of these types of construction are particularly unsuited to the installation of such an operating rod. Another problem with this design is that all one need to do to gain entry is reach through the bars of the guard and turn the operating handle. Anyone making a casual visual inspection of the guard could easily determine that an operating handle is there and it would not be difficult to figure out its function.

Another type of prior art device is somewhat improved but still exhibits drawbacks which limit its usefulness. This device is described in a brochure and includes a pair of latch and cable releases with a wall mounted foot pedal operator. Although the details of this device are somewhat vague, they include a safety release which is mounted to the outside wall and a pair of operating cables which extend through the wall and into a cable channel mounted on the interior wall. The operating cables extend parallel to the window casing and down to the wall mounted foot release which is near the bottom of the wall and directly below the cable channel. The release mechanism is not described in detail but fits into a receptacle on the window guard and holds it in a closed position. Two release mechanisms are provided per guard. The safety release may be operated by pushing the foot release which apparently retracts the cable and operates the release to pop open the guard, although this is not completely explained in the publication. This design has several drawbacks which limit its usefulness. For example, the cable must extend through the wall and must be extremely flexible to make a 90° radius within a short distance as it enters the cable channel mounted to the interior wall. This sharp 90° turn provides a rapid wearing point for the cable resulting in a frayed or broken cable and also could create the possibility of the cable jamming or hanging up. This also increases the adjustment problems over the life of the cable release as a frayed or worn cable has an increased tendency to stretch during use. Although details of the catch mechanism are not disclosed, it is apparent that it does not allow for a significant amount of tolerance to accommodate this expected variance in cable length. This problem is exacerbated by the use of two releases on a single guard whose cable lengths must be matched during installation with the travel of the foot release. Variances in adjustment between these two releases would almost inevitably occur, causing one release to operate and the other to hang up and thus prevent the guard from being opened. The foot release as disclosed is mounted on the wall which increases the installation problems due to the wide variability of materials used to construct interior walls. As mentioned above, anything from plaster board to brick and mortar may be used and some of these materials are particularly unsuited to screw type mounting as disclosed with this foot release. Furthermore, the mounting position of the foot release and the lack of a protective shield make it readily accessible through the window.

Applicant has succeeded in developing a quick release device which provides for the convenient opening of a security guard without a key, without sacrificing any of the protective benefits and without an expensive and difficult installation. Applicant's invention may be quickly and easily installed in new or existing security guards which are mounted either outside the opening or inside the opening with hinges providing either outward or inward movment of the guard when released. Applicant's cable release consists essentially of a spring loaded plunger which is swedged into the outer frame of the guard and an armored cable connected thereto and extending to a foot treadle having a shield thereon. A keeper is provided in a striker bar mounted to a door jamb or window casing which matches and lines up with the spring loaded plunger. The armored cable and spring loaded plunger are mounted in the hinged guard and sufficient length of cable may be provided to allow free movement of the guard about the hinges. The cable may be threaded through the openings between the bars in the guard and thus is easily adaptable for either an inward swinging guard or the conventional outwardly swinging guard.

Another unique feature of applicant's device is that if the armored cable is cut by one seeking to gain unauthorized entry, the spring loaded plunger would be driven home within the keeper and the flexible cable within the armored housing would withdraw inside the housing and be inaccessible. It would be necessary to peel back the armoring to gain access to the flexible cable. However, the average burglar would be stymied and would give up his attempt to gain access. It should also be noted that the armoring of the cable in applicant's preferred embodiment makes it much more difficult to cut than the actual steel bars of the guard. Thus, applicant's cable may tend to attract a burglar's attention away from the weaker part of the guard which increases the effectiveness of the guard itself.

Another advantage of applicant's invention is that if the cable is damaged, replacement thereof would be relatively easy compared with the problems of replacing the through-the-wall installations in the prior art. Burglary attempts could cause substantial damage to an owner's walls or windows and doors whereas with applicant's device, the burglar's attention is drawn to the loose cable which may be mounted completely outside of the surrounding structure.

The shielded foot treadle operator which applicant uses to operate the cable release is designed for floor mounting which has significant advantages over the wall mounted device of the prior art. For example, almost all floors are either wood or concrete which are easily adaptable for screw type mounting. Furthermore, if a carpet covers the flooring, applicant's device may be installed and removed without significant adverse effects on the appearance of the carpeting. The carpeting pile has a tendency to regain its shape and will actually conceal the screw holes made to install applicant's foot treadle. The shield for the foot treadle avoids the problem of the prior art device in that if mounted correctly, it is virtually impossible to reach through the security guard and operate the foot treadle. Also, with applicant's foot treadle mounted on the floor, small children may easily operate the cable release by using the weight of their bodies and the muscles in their legs which are the strongest muscles a youngster has. Thus, applicant's device provides for increased security with maximum convenience and safety for those installations requiring immediate opening of security guards without the use of a key.

These and other features of applicant's device may be more fully understood by referring to the drawings and description of the preferred embodiment.

DETAILED DESCRIPTION OF THE PREFERRED EMBODIMENT

Figures 1, 2, 3, 4, 5, 6:
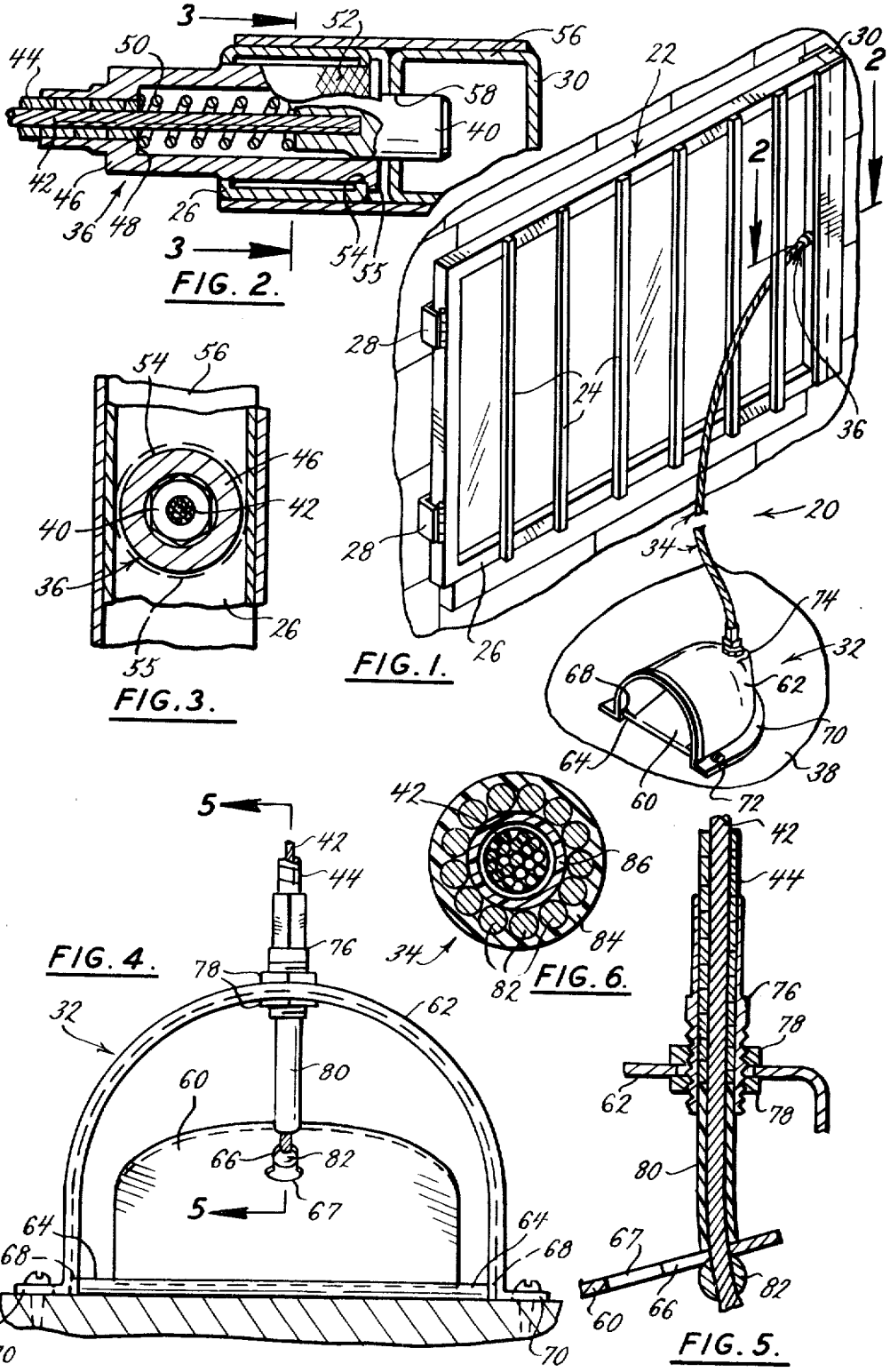
FIG. 1 is a perspective breakaway view showing a security guard in place with applicant's cable release and foot treadle installed.
FIG. 2 is a cross-sectional view taken along the plane of line 2—2 in FIG. 1 and detailing the spring loaded plunger end of the cable and the keeper.
FIG. 3 is a cross-sectional view taken along the plane of line 3—3 in FIG. 2 and detailing the plunger end of the cable mounted in the security guard frame.
FIG. 4 is a front elevational view of the foot treadle switch.
FIG. 5 is a cross-sectional view taken along the plane of line 5—5 in FIG. 4 and detailing the armored cable mounting to the foot treadle switch.
FIG. 6 is a cross-sectional view of the armored cable.

Applicant's invention of a cable release and latch 20 is shown in FIG. 1 installed in a security guard 22 having bars 24 and a frame 26. The security guard 22 is supported by hinges 28 and has a striker bar 30. Applicant's cable release and latch 20 include a foot treadle operator 32, an armored cable 34, and a spring loaded plunger 36. The armored cable 34 may extend through the bars 24 into the interior of the house or basement, as desired, for guards 22 which open either outwardly or inwardly. Either type of installation is suitable for use with applicant's cable release and latch 20. Furthermore, applicant's foot treadle operator 32 is mounted to the floor 38 which provides a safe and secure mounting and prevents the foot treadle 32 from being ripped out of its fixed installation by a would-be burglar.

As shown in FIG. 2, the spring loaded plunger 36 provides a dead bolt type latch and includes a plunger 40 which is swedged onto an end of a flexible cable 42. Flexible cable 42 is then covered by an armored housing 44 which may be one of a wide assortment of armored housing structure which inhibits ready access to the flexible cable 42. One such type of construction is shown in FIG. 6 and will be described below. Flexible cable 42 may itself be braided steel or the like which provides for reliable operation and which is capable of tight connection with plunger 40.

A plunger housing 46 provides the mounting for plunger 40 and includes a shoulder 48 which supports a spring 50 used to spring load plunger 40. Plunger housing 46 is tightly bound to the armored housing 44 such as by crimping or the like and is mounted in the frame 26 of security guard 22 through a press fit, aided by serrations 52 and a tapering of its diameter from smaller than to just equal to a receiving hole 54 formed in frame 26. A shoulder 55 may be formed at the outer edge of plunger housing 46 to aid in the installation and final positioning of plunger housing 46 in receiving hole 54. Thus, when security guard 22 is closed it is virtually impossible for anyone to remove the spring loaded plunger 36 by jerking on armored cable 34 in an attempt to pull it all the way through receiving hole 54. A keeper 56 is formed in striker bar 30 and includes a plunger hole 58 which closely matches the diameter of plunger 40 to provide for a secure locking of the guard 22 in the closed position. Striker bar 30 may be suitably mounted to the window casing or door jamb, as is known in the art.

It should be noted that plunger 40 does not extend completely into plunger hole 58 when the security guard 22 is in the latched position and that spring 50 is sized to be in compression such that if armored cable 34 is severed, spring 50 would drive plunger 40 further within the keeper 56 and the flexible cable 42 would be retracted inside the armored housing 44.

As shown in FIG. 4, the foot treadle operator 32 includes a foot platform 60 and a shield 62. The platform 60 and shield 62 may be cast from aluminum, steel or the like or even molded from high strength plastic materials, as desired. The foot platform 60 includes two depending swivel pins 64 and a cable slot 66 for receiving and holding the end of flexible cable 42. Cable slot 66 has an oversized insert hole 67 which permits the cable 42 to be inserted therein. The swivel pins 64 fit within U-shaped grooves 68 formed in the sides of shield 62. A mounting flange 70 extends around the periphery of shield 62 and has three screw slots 72 which are used to fasten the shield to the floor. A boss 74 is integrally formed near the top of the shield 62 for securing the end of armored housing 44, as shown in FIG. 5.

Referring to FIG. 5, an end fitting 76 may be crimped to the end of armored housing 44 and two nuts 78 used to secure the end fitting 76 to the boss 74. A spacer 80 is slid over the end of flexible cable 42 and maintains the spacing between the top of shield 62 and foot platform 60. A ball 82 may be formed at the end of flexible cable 42 out of solder or the like and act as a catch to hold the end of flexible cable 42 within cable slot 66.

An example of the type of armored cable 34 which may be used with applicant's cable release and latch 20 is shown in FIG. 6. A number of individual strands 82 of stainless steel or the like may be braided or helically wound to form the main protection of the armored housing 44. An outer covering 84 of vinyl or the like protects the stainless steel and gives it an attractive appearance. The vinyl covering 84 may be provided in any of a wide assortment of colors and prevents inadvertent damage to surrounding structure. An inner layer 86 of TEFLON TM or the like provides a smooth, relatively friction-free surface for the flexible cable 42 to slide over and greatly reduces any tendency of flexible cable 42 to hang up or jam. This multi-layer construction provides tremendous protection and also accommodates a great deal of twisting and turning of the cable 34 during installation and operation.

Installation and Operation

Applicant's cable release and latch 20 may be used with a security guard 22 which opens outwardly or inwardly to provide a rapid, easy, keyless opening thereof. It may be installed by first mounting a security guard 22 and a striker bar 30 with a keeper 56. The frame 26 should have a matching receiving hole 54, or one may be drilled or tapped so as to line up with plunger hole 58 in keeper 56. The armored cable 34 and spring loaded plunger 36 are first installed in receiving hole 54 by threading through the opposite end of armored cable 34 and seating the plunger housing 46 in receiving hole 54 with serrations 52. As mentioned above, the plunger housing 46 is slightly tapered so that a press fit may be formed between the outer edge thereof and the frame 26. Shoulder 55 gives a visual indication when the plunger housing 46 is fully seated in receiving hole 54. Before proceeding further, the plunger 40 may be manually operated to ensure that it is properly aligned with plunger hole 58 and that the security guard 22 may be properly latched and unlatched.

The armored cable 34 is then routed, as desired, to provide for convenient opening and closing of security guard 22 and also, foot treadle operator 32 is positioned to be generally inaccessible from the window or other opening being protected. The foot platform 60 and swivel pins 64 are positioned within U-shaped grooves 68 so that the foot platform 60 is thereby hinged. The foot treadle operator 32 may then be mounted to the floor with screws and screw slots 72 as is known in the art. The shield 62 should be oriented so that its opening is directed away from the window or other opening, thus making it almost impossible for someone to reach through the opening and operate the foot treadle operator 32. The armored cable 34 is then mounted to shield 62 by crimping an end fitting 76 onto the end of armored housing 44 and using nuts 78 to attach it to boss 74 formed in shield 62. Spacer 80 is then slid over the end of flexible cable 42 and a ball 82 of solder or the like may be formed at the end of flexible cable 42 to hold spacer 80 in position. Ball 82 is then attached to foot platform 60 through cable slot 66 and retained thereby. Care should be taken to ensure that a properly sized spacer 80 is chosen to maintain spring 50 in compression when plunger 40 is extended. For example, if the total travel of plunger 40 is three quarters of an inch, then spacer 80 should be chosen to provide for one half inch of plunger travel during normal operation. Thus, if cable 34 is severed, plunger 40 will extend another quarter inch and flexible cable 42 will retract inside armored housing 44 another quarter inch as well.

Applicant's cable release and latch 20 may then be operated by placing a foot on the foot platform 60 and depressing it using the weight of the body which retracts plunger 40 from plunger hole 58 allowing security guard 22 to be swung away from bar closure 30. The security guard 22 may be latched very easily by depressing foot platform 60, swinging security guard 22 into the closed position, and releasing foot platform 60 which allows plunger 40 to extend into plunger hole 58.

If applicant's cable release and latch 20 is tampered with by someone cutting through armored cable 34, plunger 40 is no longer restrained and spring 50 in plunger housing 46 "homes" plunger 40 deeper within plunger hole 58 in keeper 56. This "homing" action retracts flexible cable 42 inside armored housing 44 and away from the newly opened end thereof. Thus, a burglar would be forced to peel back armored housing 44 until he exposed the end of flexible cable 42 before he could manually operate the latch 20. Furthermore, even if he were familiar enough with the construction of applicant's device to cut the armored cable 34 a second time closer to the plunger 40, it would still be required to peel away some of the armored housing 44 to expose flexible cable 42. If someone were that familiar with applicant's device, they would also know that applicant's armored cable 34 is generally more difficult to cut than the bars 24 of the security guard 22 itself. Despite its appearance, applicant's armored cable 34 may be constructed of braided stainless steel wire which is substantially harder to cut than the tubular steel bars 24 usually supplied in a security guard 22.

If applicant's cable release and latch were vandalized as described above, it would only be necessary to replace the length of armored cable 34 which is relatively inexpensive compared with the repairs that would be necessary if damage were done to a through-the-wall installation as is common in the prior art. Damage to these prior art devices may even involve extensive repairing and patching of a wall which would be weakened and would never again provide the same protection.

Various changes and modifications would become apparent to one of ordinary skill in the art upon a reading of applicant's disclosure. These changes and modifications are included in the scope of applicant's teaching and he intends that his invention be limited only by the scope of the claims appended thereto.

What is claimed is:

1. In a security guard for a window or the like, a keyless latch suitable for repeated opening and closing of said security guard, means to rapidly operate said keyless latch from one side of said guard, said operation means having means to prevent operation of said latch from the opposite side of said guard, means connecting said operation means with said latch, said connection means including an armored cable extending between said latch and said operating means, said armored cable including an inner flexible cable surrounded by an armored housing and means to prevent unauthorized operation through severing said armored cable and manually moving said flexible cable, said connection means being suitable for installation outside of any supporting walls or structure within which said window or the like is mounted, the operation means including a foot treadle switch, said switch including a platform pivoted about an end thereof, means connecting an end of the flexible cable to an end of said platform opposite said pivoted end, a shield extending around said platform to prevent unauthorized operation thereof, the armored housing ending at and secured to said shield, a spacer surrounding the flexible cable and extending between said end of said armored housing and said platform to adjust and limit the movement of said flexible cable, and means to secure said switch to a support.

2. In a hinged security guard having a frame and spaced apart bars with a striker bar or the like, a cable release and keyless latch to permit the rapid and repeated opening of said latch from only one side of said security guard, said cable release and latch comprising a spring loaded plunger, means defining a hole in the frame for receiving and retaining said spring loaded plunger, a keeper in said striker bar having means defining a plunger hole which matches and lines up with said spring loaded plunger, an armored cable having an inner flexible operating cable, said spring loaded plunger being attached to said flexible operating cable, a foot treadle switch comprising a foot platform and a shield, said foot platform pivotally connected to said shield, an end fitting secured to an end of said armored housing, means securing said end fitting to said shield, means securing said flexible cable to said foot platform, a spacer surrounding said flexible cable and extending between said foot platform and said shield, and means mounting said foot treadle switch to a floor so that depressing said foot platform retracts the flexible cable inside the armored housing thereof, said flexible cable thereby retracting said plunger from within said plunger hole to release the hinged security guard and permit it to be swung away from said window or the like.

3. In a security guard for a window or the like, a keyless latch comprising a spring loaded plunger, means defining a hole in said window for receiving the plunger, a remote operating means, an armored cable comprising an armored housing and an inner flexible operating cable, said armored cable extending between and connected to the keyless latch and the operating means to permit remote operation of the keyless latch, the operating means including a pivoted platform, means connecting an end of the flexible cable to an end of said platform, means connecting the armored housing to the operating means, and a spacer surrounding the flexible cable and extending between an end of the armored housing and the platform to adjust and limit the movement of the flexible cable to thereby permit the flexible cable to retract inside the armored housing through the force of the spring loaded plunger should the armored cable be severed.

4. The device of claim 3 wherein the position of the spring loaded plunger is adjusted by the spacer to be in a spaced apart relationship with the bottom of the plunger hole when the operating means is released.

5. A cable release and keyless latch for a security guard covering a window or the like, said keyless latch comprising a spring loaded plunger, a remote operating means, an armored cable comprising an armored housing and an inner flexible operating cable, said armored cable extending between and connected to the keyless latch and the operating means to permit remote operation of the keyless latch, the operating means including a pivoted platform, means connecting an end of the flexible cable to an end of said platform, means connecting the armored housing to the operating means, and a spacer surrounding the flexible cable and extending between an end of the armored housing and the platform to adjust and limit the movement of the flexible cable to thereby permit the flexible cable to retract inside the armored housing through the force of the spring loaded plunger should the armored cable be severed.

6. The device of claim 3 or 5 wherein said latch includes a plunger and keeper, said spring means advancing said plunger into said keeper as said cable is severed.

7. The device of claim 3 or 5 wherein said latch further comprises a spring loaded plunger, said security guard further comprising a striker bar having a plunger hole which matches and lines up with said plunger and wherein said plunger extends less than all the way into said plunger hole during normal operation so that if the armored cable is severed the spring in said plunger further extends said plunger into the plunger hole, thereby retracting the flexible cable inside the armored housing.

8. The device of claim 3 or 5 wherein said operating means includes a foot treadle switch and shield suitable for floor mounting.

* * * * *